US005190151A

United States Patent [19]

Dietterich

[11] Patent Number: 5,190,151

[45] Date of Patent: Mar. 2, 1993

[54] STORAGE CONTAINER WITH INTERNAL BARRIER MEANS

[75] Inventor: Charles W. Dietterich, Brodheadsville, Pa.

[73] Assignee: Binney & Smith Inc., Easton, Pa.

[21] Appl. No.: 830,197

[22] Filed: Jan. 31, 1992

[51] Int. Cl.[5] ..... A45C 11/34; B65D 1/40

[52] U.S. Cl. ..... 206/214; 206/526; 220/674; 220/675; 220/775

[58] Field of Search ..... 206/1.7, 526, 214; 220/94 R, 94 A, 507, 529, 532, 533, 552, 553, 555, 674, 675

[56] References Cited

U.S. PATENT DOCUMENTS

| | | | |
|---|---|---|---|
| D. 40,612 | 4/1910 | Owens . | |
| D. 248,337 | 6/1978 | Marx . | |
| D. 266,207 | 9/1982 | Kirchberger et al. . | |
| D. 284,235 | 6/1986 | Zinter-Chahin . | |
| D. 290,661 | 7/1987 | Appel et al. . | |
| D. 290,853 | 7/1987 | Appel . | |
| D. 290,854 | 7/1987 | Appel . | |
| D. 298,264 | 10/1988 | Wang . | |
| D. 309,158 | 7/1990 | Shattan . | |
| D. 311,476 | 10/1990 | Kumakura . | |
| D. 320,413 | 10/1991 | Dietterich . | |
| 1,760,761 | 5/1930 | March | 220/552 X |
| 1,848,331 | 3/1932 | Esslinger | 220/553 |
| 1,912,505 | 6/1933 | Weston | 220/552 |
| 2,896,809 | 7/1959 | Metzger et al. | 220/553 |
| 2,903,127 | 9/1959 | Dorman | 220/552 X |
| 2,913,140 | 11/1959 | Vuillemenot | 220/94 A X |
| 3,471,032 | 10/1969 | Thompson . | |
| 3,670,918 | 6/1972 | Mitchell | 220/507 |
| 4,122,973 | 10/1978 | Ahern | 220/675 X |
| 4,245,685 | 1/1981 | Nemitz et al. | 220/675 X |
| 4,896,415 | 1/1990 | Bock | 220/94 R X |
| 5,050,760 | 9/1991 | Garcia | 220/94 R |

OTHER PUBLICATIONS

The Children's Design Center, p. 15, see Crayon left center-desk copy, Nov. 1981.

Toys To Grow On, see p. 29, box left center-Desk, fall 1983.

Empire Pencil Co.-see p. 42, bottom center-desk copy, 1968.

Kiddy Links Sorting Lid by Playskool, Inc. no date.

My Shape 'N Stir Pot by Playskool, Inc. no date.

My First 36 Crayons Crayon Bucket by Binney & Smith Inc. no date.

*Primary Examiner*—Bryon P. Gehman

*Attorney, Agent, or Firm*—Leydig, Voit & Mayer

[57] ABSTRACT

A storage and carrying container (10) for children's possessions having at least a body portion (14), a handle portion (16) and internally disposed barrier elements (17), (18), (19), (20) serving to reduce the effective diameter of the body portion thereby preventing a child from substantially inserting his or her head into the internal storage area thus preventing the child from utilizing the container as a hat.

16 Claims, 1 Drawing Sheet

STORAGE CONTAINER WITH INTERNAL BARRIER MEANS

FIELD OF THE INVENTION

The present invention relates generally to portable storage containers and more particularly to a new and useful storage container for use by children in the storage and transportation of drawing supplies and like possessions.

BACKGROUND OF THE INVENTION

Portable storage containers for children's possessions have been previously used and are well known. However, a small child may place the open end of the storage container on his or her head similar to placing a hat on his or her head. Under some circumstances, children may experience difficulty in removing the storage container from their head.

OBJECTS AND SUMMARY OF THE INVENTION

The principal object of the present invention is to provide a portable storage container for children's possessions having internally disposed barrier elements. These barrier elements will prevent young users from using the storage container as a hat and from substantially inserting their heads into the storage container.

In accomplishing these objectives, the present invention provides a portable storage container having internally disposed barrier elements. These barrier elements may be formed either integrally with the storage container or as separate modular units which may be sealed within the container body by appropriate attachment means. The portable storage container may be provided with a manually detachable lid portion. The barrier elements may vary in number and geometry although in the preferred embodiment, four substantially rectangular barrier elements will be disposed longitudinally against the inner wall of the container body effectively reducing the diameter of the container and thereby preventing a child from inserting his head into the container body. In addition, the storage container may also be provided with a rotatable handle with tabs disposed thereon to effectively secure the lid to the body of the container during the carrying operation.

DETAILED DESCRIPTION OF THE INVENTION

Figures 1, 2, 3, 4, 5, 6, 7, 8, 9:
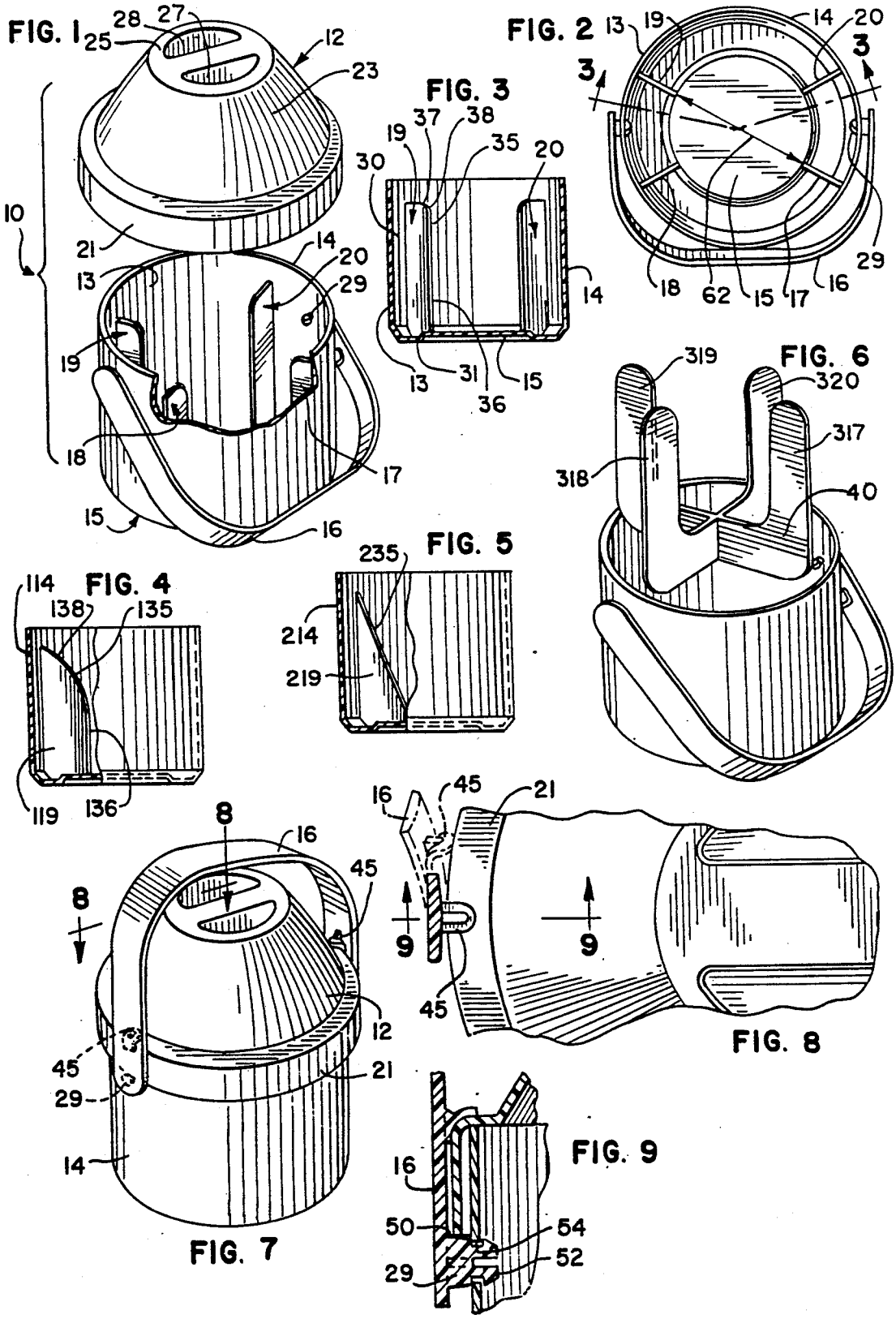
FIG. 1 is an exploded perspective view of a lid and a portable storage container which utilizes the internally disposed barrier means of the present invention formed integrally with the body portion of the container.
FIG. 2 is a top view of the portable storage container shown in FIG. 1 without the lid.
FIG. 3 is a cross-sectional view along line 3—3 of FIG. 2.
FIG. 4 is a side elevation view partially cut away of a portable storage container having an internally disposed barrier element.
FIG. 5 is a side elevation view partially cut away of a portable storage container having an internally disposed barrier element.
FIG. 6 is an exploded perspective view of an alternate embodiment of a portable storage container wherein the barrier means of the present invention comprise an externally formed modular unit.
FIG. 7 is an external perspective view of the portable storage container with the lid positioned on the container and handle means in upright and activated position.
FIG. 8 is a partial cross-sectional view along line 8—8 of FIG. 7.
FIG. 9 is a partial cross-sectional view along line 9—9 of FIG. 8.

Referring now to the drawings, a portable storage container 10 for the storage of children's possessions, including drawing supplies and the like, is shown generally in FIG. 1. The portable storage container 10 includes a lid portion 12, a body portion 14, rotatable handle means 16 and barrier elements 17, 18, 19, 20 disposed within body portion 14. The body portion 14 includes a cylindrical wall 13 and a bottom 15.

The lid portion 12 of portable storage container 10 is of a generally frustroconical shape comprising a base section 21, a cone section 23 and a head section 25. In the preferred embodiment of the present invention, the inner diameter of the base section 21 of lid portion 12 is greater than the outer diameter of body portion 14, thereby permitting the lid portion 12 to serve as a cover for body portion 14 as shown most clearly in FIG. 7. The covering operation is effected manually by means of finger tabs 27, 28 located on head section 25 of lid portion 12. Finger tabs 27, 28 afford a user with small hands the ability to secure a grip on lid portion 12, thereby permitting the user to manually engage and disengage lid portion 12 and body portion 14.

As seen in FIG. 1 and as will be discussed further in relation to FIGS. 8 and 9, the handle means of portable storage container 10 are rotatable. Accordingly, the handle means 16 of the present invention include rotatable lugs 29 disposed through the cylindrical wall 13 of body portion 14.

As seen by reference to FIGS. 1-3, the barrier elements 17, 18, 19, 20 comprise generally a plurality of longitudinally disposed rib structures. The barrier elements 17, 18, 19, 20 are similar in construction. Therefore, in order to save space, only barrier element 19 will be described in detail. Referring to FIG. 3, barrier element 19 includes a wall edge portion 30, a bottom edge portion 31 and an anterior edge 35. The wall edge portion 30 is formed by the intersection of the barrier element 19 with the wall 13 of body portion 14. The bottom edge portion 31 is formed by the intersection of the barrier element 19 with the bottom 15.

In the particular embodiment shown in FIG. 2, the storage container has four barrier elements 17, 18, 19, 20 which are position around the cylindrical wall 13. Barrier elements 18 and 19 are located approximately 60 degrees away from each other around the circumference of the wall. Similarly, barrier elements 17 and 20 are located approximately 60 degrees away from each other around the circumference of the wall. Finally, barrier elements 19 and 20 are located approximately 120 degrees away from each other around the circumference of the wall. Similarly, barrier elements 17 and 18 are located approximately 120 degrees away from each other around the circumference of the wall.

However, the number and location of the barrier elements can be different. For example, the storage container can have only three barrier elements, which are equally spaced around the circumference of the wall. In another example, the storage container would have only one barrier element. In yet another example, the storage container would only have one barrier element which extends across the diameter of the container. In the preferred embodiment, the barrier elements 17, 18, 19, 20 are formed integrally with respect to body portion 14 by means of injection molding well known to those skilled in the art.

In general, as seen in FIG. 3, the anterior edge 35 of the barrier element 19 is free of geometric irregularities such as corners and edges upon which a user could be injured. The preferred geometry of the barrier element 19 is shown in FIG. 3. The anterior edge 35 of the barrier element 19 has a vertical portion 36, a horizontal position 37 and a curved portion 38. The vertical portion 36 extends upward from the bottom 15. The horizontal portion 37 extends inwardly from the wall 13. The vertical portion 36 and horizontal portion 37 are joined by the curved portion 38.

Referring to FIG. 4, an alternative embodiment of the barrier element is shown. The barrier element 119 has a geometry wherein the curved portion 138 of the anterior edge 135 extends from the wall 13 to the vertical portion 136. Another alternative embodiment is presented in FIG. 5 wherein barrier element 219 is of a substantially right-triangular configuration with anterior edge 235 forming essentially the hypotenuse of such configuration.

While, as discussed above, the barrier elements will generally be formed integrally with body portion 14 by means of a molding process, an alternative embodiment of the present invention utilizes barrier elements 317, 318, 319, 320 which comprise a separately formed barrier unit 40 as seen in exploded view in FIG. 6. The barrier unit 40 may be one component or may be two or more components joined or assembled together to form the barrier unit 40. In this particular embodiment, the barrier elements 317, 318, 319, 320 are located 90 degrees away from each adjacent barrier element. The modular unit 40 may be inserted into body portion 14 and then sealed in place by means of either a thermal or chemical adhesion process as is well understood in the art.

As seen from a comparison of FIG. 1 and FIG. 7, the handle portion 17 of portable storage container 10 is rotatable about an axis defined by rotatable lugs 29. A cross section of a rotatable lug 29 as may be used in the present invention is shown in FIG. 9. As shown, rotatable lug 29 includes an external portion 50, an internal portion 52 and groove means 54. In the preferred orientation, the wall of body portion 14 is disposed within groove means 54, thereby allowing lug 29 to freely rotate within body portion 14 while preventing the removal of lug 29. The external portion 50 of lug 29 is connected to handle 17, thereby transferring the rotatable characteristics of the lug to the handle.

In the preferred embodiment of the present invention the utility of rotatable handle portion 17 is enhanced by means of tabs 45 as best seen in FIG. 8. Tabs 45 are disposed substantially perpendicular to the inner surface of rotatable handle portion 16. In operation, with handle portion 16 in the position shown in FIG. 1, lid portion 12 of portable storage container 10 is manually placed over body portion 14 in the manner previously described. Upon raising handle portion 16 to the carrying position shown in FIG. 7, tabs 45 are disposed above the base section 21 of lid portion 12, thereby serving to secure lid portion 12 in place during the carrying operation. Substantial interference between sealing tabs 45 and base section 21 of lid portion 12 is avoided by handle portion 17 flexing as it is raised to the carrying position shown in FIG. 7.

In operation, the disposition of barrier elements 17, 18, 19 and 20 will prevent a user from substantially inserting his or her head into body portion 14. Should a user attempt to use the container as a hat, insertion of his or her head will be substantially limited by the reduction in free space in the body portion 14 of storage container 10 effected by the presence of the barrier elements 17, 18, 19, 20. While, in the preferred embodiment, the diameter of the body portion 14 as defined by cylindrical wall 13 is approximately 6 inches, the disposition of barrier elements 17, 18, 19, 20 effectively reduces the diameter 62 of the free space available for insertion to approximately 4 inches. Should a child with a head greater than the effective diameter 62 of the free space defined by barrier elements 17, 18, 19, 20 attempt to insert his or her head into the storage container 10, resistance will be encountered prior to insertion being achieved.

While specific embodiments of the invention have been shown and described, it will be understood, of course, that the invention is not limited thereto, since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope of the following claims.

What is claimed is:

1. A portable storage container for use in the storage and transportation of children's possessions, said portable storage container comprising a body portion and internally disposed barrier means to prevent the substantial insertion of a child's head into said storage container, said body portion comprising an inner surface and an outer surface, said inner surface defining an inner materials storage area, said barrier means each being substantially planar in shape and disposed within and only partially across said inner materials storage area to define an open area between the inner edge of each barrier means and an opposing portion of the inner surface, each plane defined by the barrier means extending from said inner surface, said barrier means thereby permitting insertion of a child's hand into said inner materials storage area while prohibiting the substantial insertion of a child's head into said inner materials storage area.

2. The invention as in claim 1 wherein said barrier means is at least one longitudinally disposed rib structure.

3. The invention as in claim 2 wherein said at least one longitudinally disposed rib structure comprises a preformed modular unit which may be inserted into said inner materials storage area and thereafter sealed to said inner surface of said body portion.

4. The invention as in claim 2 wherein said at least one longitudinally disposed rib structure is substantially rectangular in shape.

5. The invention as in claim 2 wherein said at least one longitudinally disposed rib structure has substantially rounded anterior edges.

6. The invention as in claim 2 wherein said at least one longitudinally disposed rib structure is of a substantially right-triangular shape.

7. The invention as in claim 1 wherein said body portion and said barrier means are integral.

8. The invention as in claim 1 and including a handle means for carrying said container.

9. The invention as in claim 8 wherein said handle means is rotatably mounted to said body portion.

10. The invention as in claim 9 wherein sealing tabs are disposed normally to said handle means.

11. The invention as in claim 1 and including a lid portion.

12. The invention as in claim 11 wherein said lid portion is disposed in manually detachable sliding relation to said body portion.

13. The invention as in claim 11 wherein said lid portion includes slotted removal means to aid in the removal of said lid.

14. The invention as in claim 1 wherein said barrier means comprises a single longitudinally disposed rib structure.

15. A portable storage container for use in the storage and transportation of children's possessions, said portable container comprising a body portion and internally disposed barrier means to prevent the substantial insertion of a child's head into said storage container, said body portion including a substantially cylindrical wall portion and a substantially round base portion, said internally disposed barrier means comprising axially longitudinal planar rib members extending radially perpendicular to the cylindrical wall portion comprising a horizontal upper portion and a vertical exterior edge connected by a curved intermediate corner portion, said rib members being disposed substantially perpendicular to the inner surface of said body portion by means of connection to said wall portion and said base portion of said body portion, said rib members each extending only partially across said body portion and not engaging each other, the disposition of said barrier means within said body portion thereby permitting insertion of a child's hand into said body portion while prohibiting the substantial insertion of a child's head into said body portion.

16. A portable storage container for use in the storage and transportation of children's possessions, said portable storage container comprising a body portion, a lid portion, internally disposed barrier means to prevent the substantial insertion of a child's head into said storage container and a rotatable handle portion, said body portion including a substantially cylindrical wall portion and a substantially round base portion, said lid portion being of a substantially frustoconical configuration comprising a base section, a head section and a cone section connecting said head section and said base section, said head section including finger tabs to permit users having small hands to grasp said lid portion, said internally disposed barrier means comprising axially longitudinal planar rib members extending radially perpendicular to the cylindrical wall portion comprising a horizontal upper portion and a vertical exterior edge connected by a curved intermediate corner portion, said rib members being disposed substantially perpendicular to the inner surface of said body portion by means of connection to said wall portion and said base portion of said body portion, said rib member each extending only partially across said body portion and not engaging each other, the disposition of said barrier means within said body portion thereby prohibiting the substantial insertion of a child's head into said body portion, said rotatable handle portion being attached to said body portion by means of freely rotatable lugs disposed within said wall portion, said rotatable handle portion further including tabs disposed substantially perpendicular to the interior surface of said handle, said tabs being disposed above said base section of said lid portion when said handle is rotated into a carrying position thereby securing said lid portion to said body portion during the carrying operation.

* * * * *

UNITED STATES PATENT AND TRADEMARK OFFICE

CERTIFICATE OF CORRECTION

PATENT NO. : 5,190,151

DATED : March 2, 1993

INVENTOR(S) : Charles W. Dietterich

It is certified that error appears in the above-indentified patent and that said Letters Patent is hereby corrected as shown below:

Column 6, line 24, "member" should be --members--.

Signed and Sealed this

Thirtieth Day of November, 1993

*Attest:*

*Attesting Officer*

BRUCE LEHMAN

*Commissioner of Patents and Trademarks*